US006105591A

United States Patent [19]

DeCare et al.

[11] Patent Number: 6,105,591

[45] **Date of Patent: *Aug. 22, 2000**

[54] METHODS AND COMPOSITIONS FOR CLEANING BLACK POWDER RIFLES

[76] Inventors: Thomas John DeCare, RD #2 Darrow Rd.; Leslie Allen Phelps, 7 Darrow Rd., both of Mexico, N.Y. 13114; Leslie Harold Volles, 4854 Glinden La., Syracuse, N.Y. 13215

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,241

[22] Filed: Jun. 4, 1996

[51] Int. Cl.[7] ..... B08B 9/00

[52] U.S. Cl. ..... 134/22.19; 134/22.14; 134/122.11; 134/8; 134/3; 134/2; 134/20; 134/40; 510/437; 510/417; 510/407; 510/119; 252/100; 252/95

[58] Field of Search ..... 134/22.19, 22.14, 134/8, 3, 2, 20, 40, 22.11; 252/100, 95; 510/437, 417, 407, 119

[56] References Cited

U.S. PATENT DOCUMENTS

| | | | |
|---|---|---|---|
| 126,615 | 5/1872 | Wood | 102/532 |
| 407,890 | 7/1889 | Day | 102/511 |
| 1,039,774 | 10/1912 | Melander | 102/511 |
| 1,495,008 | 5/1924 | Feagin | 102/442 |
| 2,047,897 | 7/1936 | Symes | 102/442 |
| 2,346,124 | 4/1944 | Dew | 508/583 |
| 3,899,398 | 8/1975 | Cole et al. | 201/2.5 |
| 4,205,475 | 6/1980 | Wilson | 42/90 |
| 4,353,282 | 10/1982 | Holt | 86/19 |
| 4,414,128 | 11/1983 | Goffinit | 252/111 |
| 4,417,521 | 11/1983 | Dahlitz | 102/511 |
| 4,613,446 | 9/1986 | Magyar | 252/91 |
| 4,702,028 | 10/1987 | Dahlitz | 42/90 |
| 4,715,285 | 12/1987 | Holler | 102/435 |
| 4,735,146 | 4/1988 | Wallace | 102/511 |
| 4,759,885 | 7/1988 | Kurtz | 264/3.1 |
| 4,783,925 | 11/1988 | Pollock, Jr. | 42/90 |
| 4,806,274 | 2/1989 | Crouse et al. | 252/548 |
| 4,858,360 | 8/1989 | Hardin | 42/95 |
| 5,031,648 | 7/1991 | Lutener et al. | 134/32 |
| 5,164,539 | 11/1992 | French | 102/520 |
| 5,446,987 | 9/1995 | Lee et al. | 42/61 |
| 5,490,947 | 2/1996 | Cioffe | 252/100 |

*Primary Examiner*—Keith D. MacMillan
*Assistant Examiner*—T. D. Wessendorf
*Attorney, Agent, or Firm*—Harter, Secrest & Emery LLP; Stephen B. Salai

[57] ABSTRACT

A method is disclosed for cleaning a black powder firearm with a patch saturated with an aqueous emulsion. The aqueous emulsion includes a detergent, a lower alcohol and an essential oil. The saturated patch is loaded into a charged firearm with a projectile, and the firearm is then discharged.

19 Claims, 1 Drawing Sheet

METHODS AND COMPOSITIONS FOR CLEANING BLACK POWDER RIFLES

FIELD OF THE INVENTION

The present invention relates to black powder and muzzle loaded firearms. More particularly, the present invention relates to a cleaning composition for use with a firing patch.

BACKGROUND OF THE INVENTION

Muzzle loaded and black powder firearms have long been used by hunters and by numerous hobbyists. The popularity and use of these firearms has increased dramatically over the past several years. Typically such firearms are charged with black powder, a patch and a projectile, all of which are loaded through the muzzle, such that the projectile rests upon the charge. The black powder is then ignited by transferring a spark through a small hole or "nipple" located in the base of the barrel. The expanding gases generated from the combustion of the powder create enormous pressures upon the projectile, typically a ball, which act to fire the projectile down range.

However, the design and function of black powder rifles create numerous problems. Due to the pressures and temperatures involved and the size of the ball relative to the barrel, small pieces of lead may be sheared off when firing the rifle. This lead may accumulate upon the bore thereby reducing the bore diameter. Accumulation of materials, such as lead, upon the bore wall increases the danger of having the barrel explode upon igniting the charge. Lead build-up is further undesirable since it decreases the accuracy of the firearm as well as the life expectancy of the weapon.

In addition to lead build-up, combustion of the black powder within the firearm also causes significant unwanted "fouling" or residue build-up. Black powder generally contains a mixture of potassium nitrate, charcoal and sulfur. When ignited, the nearly instantaneous reaction causes much of the unreacted materials and the resulting by-products to exit the bore. However, a significant amount of the residue becomes deposited upon the bore wall. This residue often includes potassium carbonate, potassium sulfate, potassium sulfide, sulfur, potassium nitrate, potassium thiocyanate, ammonium carbonate and carbon. Furthermore, in the presence of ambient air, which includes oxygen and water, these residues may react with the metal barrel to form iron sulfide and iron oxide. The formation of which rusts and pits the bore. Irregularities within the bore, such as those caused by pitting or residue build-up, decrease both the accuracy and life expectancy of the firearm.

As is known in the art, the black powder is initially loaded within the barrel of the firearm. Thereafter, a ball and patch are then loaded into the barrel of the rifle such that the patch is positioned between the black powder and ball. The patch typically wraps around the ball in the barrel acting as a barrier between the charge as well as the bore wall; the resulting lead build-up is therefore significantly reduced. In addition, the firing patch can also increase the accuracy of the rifle since the patch effectively transfers the spin of the rifling of the bore to the ball. In order to increase the ease with which the ball and firing patch are loaded into the bore it is known in the art to use vegetable oil, tallow or waxes to lubricate the patch prior to loading the firearm.

Despite the use of a patch, residue build up remains a significant problem which is addressed by manually cleaning the bore after each shot. However, to date, problems with lead and residue build-up have been largely dealt with by manually cleaning the rifle bore after each shot. Manual cleaning is preferably performed after each shot since the longer the residue remains upon the barrel wall, the greater the corrosion caused by the formation of the iron oxides and iron sulfides. Failure to adequately clean the bore of residue deposits seriously detracts from the accuracy of the firearm and will eventually prevent seating of the ball adjacent the charge. Often individuals use water or other solvents in conjunction with cleaning pads and a steel bore brush after each shot in order to remove residue. However, water often contaminates the nipple hole which prevents the primary charge from transferring a spark to the black powder, thereby causing a misfire or a seriously delayed ignition after referred to as a "hang fire". In addition, the fouling problems are experienced even when a firearm uses minimum powder charges, has shallow rifling in the barrel or is used under ideal environmental conditions.

Therefore, there exists a need for a composition and method for removing and preventing build-up of residue upon the bore of a firearm which allows the shooter to repeatedly load and fire the weapon without the need to clean the firearm after each shot. In addition, there exists a need for such a composition and method compatible with black powder charges and which does not itself cause corrosive gases or residues. Further, there exists a need for such a composition and method using materials which are environmentally friendly and which do not pose health risks since the rifles are often loaded and cleaned by hand. Further, there exists a need for a composition and method that does not cause misfires, hangfires, or lower the accuracy of the firearm. In addition, there exists a need for a composition and method of cleaning the black powder rifle compatible in a wide variety of environmental conditions since the rifles are used in varied weather conditions.

SUMMARY OF THE INVENTION

The aforesaid needs are fulfilled and the problems of the prior art overcome by coating a patch with a cleaning composition comprising an emulsion of a surface-active agent, water, a polar solvent. Loading the coated patch and a projectile into a charged firearm and then discharging the firearm acts to effectively clean the rifle bore. The polar solvent may include lower organic compounds having an oxygen functionality, examples including lower alcohols. The emulsion may further comprise a non-polar solvent, an example being an essential oil such as pine oil or orange oil. In a further aspect, the surface active agent may comprise a detergent, such as a soap of tall oil, and the polar solvent a lower alcohol selected from the group consisting of methanol, ethanol and isopropyl alcohol. In a further aspect of the invention, the non-polar solvent may comprise up to about 10% by weight, the lower alcohol 5 to 50% by weight, and the surface-active agent from 1–25% by weight of the aqueous emulsion.

DESCRIPTION OF THE INVENTION

Figure 1:
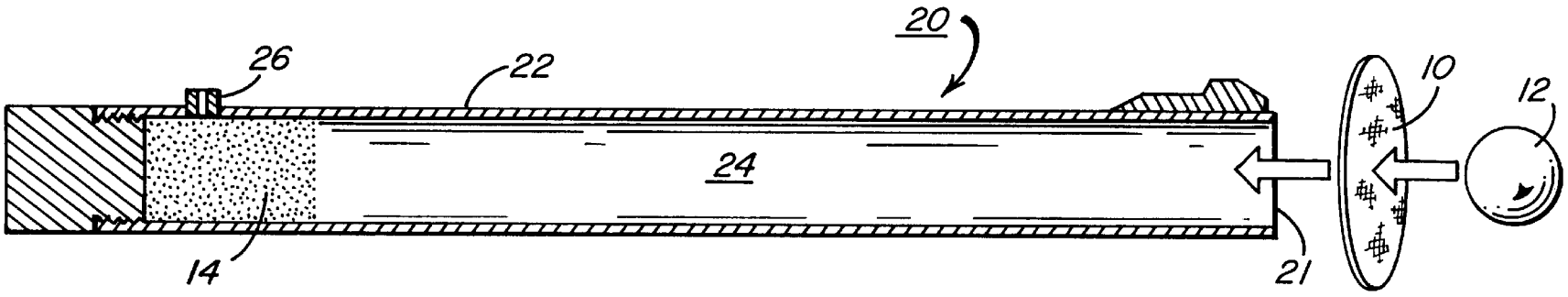
FIG. 1 is a cross-sectional side view of a charged black powder rifle prior to loading a ball and patch.
Figure 2:
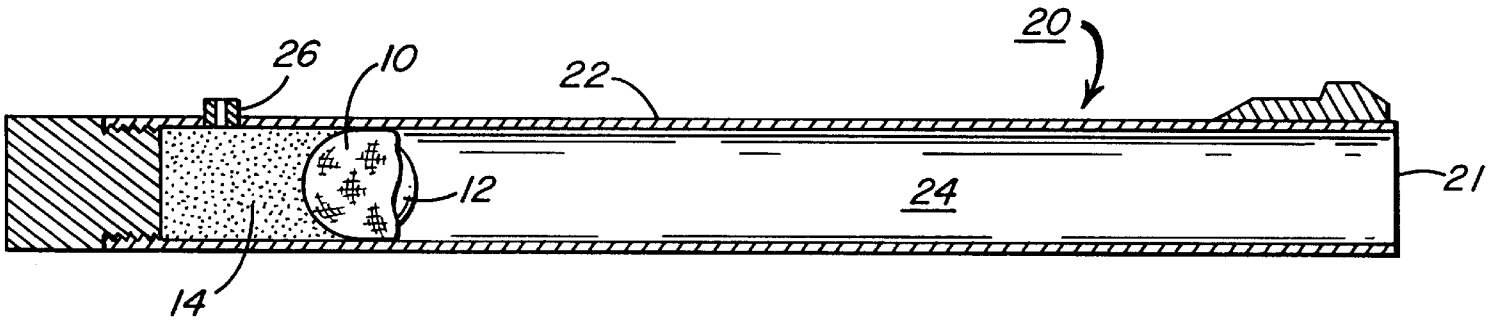
FIG. 2 is a cross-sectional side view of the charged black powder rifle of FIG. 1 loaded with the ball and patch.

A preferred method of the present invention may comprise saturating an absorbent patch with an aqueous emulsion comprising a surface-active agent, a polar solvent and a non-polar solvent. The cleaning patch may then be used in a manner as existing firing patches. As shown in FIGS. 1 and 2, after charging the firearm 20 with the desired amount of black powder 14, the coated patch 10 and ball 12 may be loaded into the firearm such that the patch lies between the charge 14 and ball 12. After the ball 12 and patch 10 are tapped into the muzzle 21 a ramrod may be used to force the patch 10 and ball 12 down the length of the barrel 22. This allows the patch 10 to clean any residue deposited upon the bore wall 24. Igniting the charge through nipple 26 then causes the patch 10 and ball 12 to move through the barrel 22 and fired down range, further cleaning the bore wall 24. The present invention may be used in the normal use of the firearm although it eliminates the need to manually clean the bore after each shot.

Numerous black powder formulations or other charges used in connection with muzzle loading or black powder firearms, may be used in conjunction with the present invention. In addition, the saturated or coated patch used in connection with the present invention may comprise standard patches which are commercially available. Preferred materials for the patch consist of absorbent materials such as cloth, examples including, but not limited to, linen, felt, denim, wool and pillowticking. The cloth patches are preferably from 0.010 to 0.020 inches thick. Standard sized and configured patches may be used although non-conventional patches may also be utilized with the present invention; an example being the patch taught in U.S. Pat. No. 4,702,028 issued to Dahlitz.

In addition, it is known for the charge, patch and projectile to be incorporated into an integral unit in order to ease loading of the firearm. For the purposes of the present invention and as used herein, the term "patch" includes material expelled upon discharging the firearm which is used to separate the charge and the projectile or to otherwise envelop the projectile. An example of such rounds include those taught in U.S. Pat. No. 5,164,539 issued to French and U.S. Pat. No. 4,759,885 issued to Kurtz.

The patch may be coated or saturated with an aqueous emulsion comprising a surface-active agent, a lower alcohol and a non-polar solvent. A surface-active agent, such as an emulsifier or surfactant, is used in order to allow the constituents to exist in a single liquid phase and may comprise from about 1 to 25% by weight of the emulsion. It is believed that anionic, cationic or non-ionic surfactants may be utilized in connection with the present invention, although anionic surfactants such as detergents are preferred. In particular, a natural soap formed from tall oil and alkali metal hydroxides works particularly well in the present invention. As used herein, the term "detergents" refers to both natural and synthetic detergents and soaps. Examples of synthetic detergents believed compatible with the present invention include the sulfonates and sulfates of higher fatty acids. The alkali metal, ammonium or amine salts of the sulfates and sulfonates may be of the general formula $R—CH_2—O—SO_3^-M^+$ and $R—CH_2—SO_3^-M^+$. Examples include, sulfonated oils, sulfonated polyhydric alcohols and sulfated aromatic compounds such as alkyl benzene sulfonate. Synthetic detergents, such as sodium dodecyl sulfate (SDS), may be advantageous in certain formulations since they are soluble in the presence of hard water containing alkaline earth metals.

In addition, cationic surfactants such as quaternary ammonium salts in which one of the alkyl groups is a long chain hydrocarbon are also believed useful in the present invention. Further, neutral or non-ionic surfactants containing a multiplicity of ether or hydroxyl functional groups with a hydrophobic long chain hydrocarbon are also believed to be suitable for use in the present invention. Preferably, the extended hydrophobic chain contains from about 12 to 20 carbons. Examples include alkyl polyethylene glycol, fatty acid esters of polyethylene glycol, tweens (long chain fatty acid monoesters of sugar alcohol anhydrides with polyoxyethylene chains added for water solubility), polyhydric alcohol derivatives such as polyvinyl alcohol and also polyether and amine soaps such as triethanolamine salts of higher fatty acids.

The polar solvents that may be used in connection with the present patch include lower organic compounds having an oxygen functionality miscible with essential oils and neutralized aqueous soaps. Examples of suitable polar solvents include, but are not limited to, water soluble lower alcohols such as methanol, ethanol, propanol, butanol and their isomers, glycerol, ethylene glycol and ethyl acetate. As used herein, the term "lower" includes those having 1 to 7 carbons. In addition, lower aliphatic and aromatic alcohols miscible with water may also be utilized in connection with the present invention. Denatured alcohols, such as Formula 3A denatured alcohol (100 parts ethanol to at least 5 parts methanol), is a preferred polar solvent. However, less expensive and less regulated solvents such as isopropanol may be preferred from a commercial standpoint. The weight percent of the polar solvent within the emulsion may range from 5 to 50%, preferably about 10 to 29% and even more preferably about 25 to 29% (by weight).

In addition to the polar solvent, the emulsion may further contain a non-polar solvent. Examples of such non-polar solvents are essential oils, such as pine oil or orange oil. The non-polar solvents may comprise from 0 to about 10 % by weight of the emulsion, preferably about 0.5 to 2%. In this regard, terpenes such as alpha-terpineol, limonene and 2,2,4-trimethylpentane are preferred non-polar solvents. Non-polar solvents such as benzene are also believed to exhibit the proper functionality and non-polarity for use within the present invention. However, materials such as benzene are preferably avoided due to the related health concerns.

EXAMPLE I 2.4 grams of tall oil is thoroughly mixed with 7.5 grams of formula 3A denatured alcohol (100 parts ethanol to 5 parts methanol). 19.65 grams of 0.432 N NaOH was added to the solution and mixed thoroughly. This neutralizes the tall oil acidity thereby forming the corresponding fatty acid salt. (The normality of NaOH solution is based on a tall oil acidity determination, such that adding aqueous sodium hydroxide solution adjusts the pH to about 9) Thereafter, 0.45 grams of pine oil was added to the solution and mixed thoroughly, for a final solution weight of 30 grams. Upon final mixing a clear colorless solution is created.

EXAMPLE II 90 grains of black powder were poured into the bore of a 0.050" caliber deep grooved Green Mountain barrel. A 0.020 inch thick cotton patch is soaked in the emulsion of Example I, the saturated patch and a lead ball were then loaded into the barrel so as to rest upon the charge with the patch positioned between the charge and the lead ball. The gun was fired, extricating the patch and lead ball. Without cleaning between shots, a series of ten shots was conducted. The patch used in the first shot was black whereas remaining patches of shots 2 through 10 were substantially clean and did not exhibit substantial residue. It is believed that the initial patch was black due to the oil, such as standard petroleum based gun oil, which is used to treat the gun barrel during storage. Shot groupings of the ten rounds were excellent.

EXAMPLE III

The same procedure was conducted as above except 120 grains of black powder were used and similar results were achieved. In addition, the test was also performed using 90 grains of black powder and a patch of thickness of 0.010 which resulted in clean patches which were damp and experienced a slight disparity in shot grouping.

EXAMPLE IV

The materials identified below were mixed in the manner described above in reference to Example I and tested as in Example II. The results are set forth below.

| Emulsion No. | Reag. $H_2O$ (g) | Surface Active Agent (g) | Polar Solvent (g) | Non-Polar Solvent (g) | Comments |
|---|---|---|---|---|---|
| 1 | 19.65 | 2.4 tall oil | 7.5 EtOH | 0.45 pine oil | |
| 2 | 20.10 | 2.4 tall oil | 7.5 Form. 3A | 0.00 pine oil | Gel-like phase on bottom at 0° F., slow mixing at room temperature |
| 3 | 19.88 | 2.4 tall oil | 7.5 Form. 3A | 0.225 pine oil | |
| 4 | 20.85 | 1.2 tall oil | 7.5 Form. 3A | 0.45 pine oil | |
| 5 | 19.65 | 1.2 tall oil | 8.7 Form. 3A | 0.45 pine oil | Minimum phase on bottom at 0° F., resistant to mixing at room temperature |
| 6 | 17.25 | 4.8 tall oil | 7.5 Form. 3A | 0.45 pine oil | Most phase at bottom at 0° F., mixed well at room temperature; slight residue on patches |
| 7 | 19.65 | 2.4 tall oil | 7.5 MeOH | 0.45 pine oil | slight residue on patches |
| 8 | 19.65 | 2.4 tall oil | 7.5 i-PrOH | 0.45 pine oil | |
| 9 | 19.65 | 2.4 tall oil | 7.5 Form. 3A | 0.45 pine oil | Tap water used, hardness caused precipitate formation |
| 10 | 19.65 | 2.4 SDS | 7.5 Form. 3A | 0.45 pine oil | Pine oil miscible in about 2 minutes adjusted to pH 10 |
| 11 | 19.65 | 2.4 tall oil | 7.5 Form. 3A | 0.45 orange oil | Orange oil miscible in 5–10 minutes; slight residue on patch |
| 12 | 19.65 | 2.4 tall oil | 7.53 Form. 3A | 0.45 2,2,4-trimethyl pentane | 2,2,4-trimethylpentane miscible in 3–5 minutes |

While the invention has been particularly shown and described in detail with reference to the preferred embodiment, it will be understood to those skilled in the art that modifications in form and detail may be made without departing from the spirit and scope of the invention.

We claim:

1. A method of cleaning a black powder firearm, comprising:

coating or saturating an absorbent firing patch with an aqueous emulsion comprised of the following constituents: (a) about 1 to 25% by weight of a surface-active agent, (b) about 5 to 50% by weight of an alcohol, and (c) 0 to about 10% by weight of a non-polar solvent, wherein said surface-active agent allows the constituents to exist in a single liquid phase;

loading a black powder charge, said patch and a projectile into said firearm; and then firing said firearm, wherein said projectile and said patch are ejected from said firearm, thereby removing and preventing build-up of black powder residue upon a bore of said firearm.

2. The method of claim 1, wherein said surface active agent is a detergent.

3. The method of claim 2, wherein said surface active agent is saponified tall oil.

4. The method of claim 1, wherein said alcohol is a lower alcohol having from 1 to 7 carbon atoms.

5. The method of claim 4, wherein said alcohol is one or more from the group consisting of methanol, ethanol, and isopropyl alcohol.

6. The method of claim 5, wherein said alcohol is a mixture of ethanol and methanol.

7. The method of claim 4, wherein said percentage by weight of said non-polar solvent in said emulsion is greater than 0% by weight and wherein said non-polar solvent is an essential oil.

8. The method of claim 7, wherein said essential oil is a pine oil, orange oil, or a mixture of pine oil and orange oil.

9. The method of claim 4, wherein said percentage by weight of said non-polar solvent in said emulsion is greater than 0% by weight and wherein said non-polar solvent is a terpene.

10. A black powder firearm cleaner composition, comprising:

an absorbent firing patch saturated with an aqueous emulsion having constituents consisting of (a) about 1 to 25% by weight of a surfactant, (b) about 5 to 50% by weight of an alcohol, and (c) 0 to about 10% by weight of a non-polar solvent, wherein said surfactant allows the constituents to exist in a single liquid phase.

11. The black powder firearm cleaner composition of claim 10, wherein said percentage by weight of said non-polar solvent in said emulsion is greater than 0% by weight and said alcohol is a lower alcohol having from 1 to 7 carbon atoms.

12. The black powder firearm cleaner composition of claim 11, wherein said lower alcohol is about 10 to 29% by weight of said emulsion.

13. The black powder firearm cleaner composition of claim 10, wherein said alcohol is one or more from the group consisting of methanol, ethanol, and isopropanol.

14. The black powder firearm cleaner composition of claim 10, wherein said surfactant is a detergent.

15. The black powder firearm cleaner composition of claim 10, wherein said surfactant is a soap of tall oil.

16. The black powder firearm cleaner composition of claim 10, wherein said percentage by weight of said non-polar solvent in said emulsion is greater than 0% by weight and said non-polar solvent is a terpene.

17. The black powder firearm cleaner of claim 10 , wherein said percentage by weight of said non-polar solvent in said emulsion is greater than 0% by weight and wherein said non-polar solvent is selected from the group consisting of pine oil and orange oil.

18. A black powder firearm cleaning composition consisting of an aqueous emulsion consisting of:

(a) about 3 to 20% by weight of a detergent surfactant;

(b) about 10 to 29% by weight of a polar solvent comprising one or more lower alcohols selected from the group consisting of methanol, ethanol, propanol, and butanol; and (c) about 0.5 to 2% by weight of a non-polar solvent selected from the group consisting of pine oil, orange oil, alpha-terpineol limonene, 2,2,4 -trimethylpentane, and benzene;

wherein the pH of said emulsion ranges from about 9 to about 10.

19. A method comprising:

coating or saturating an absorbent firing patch with an aqueous emulsion consisting essentially of (a) about 1 to 25% by weight of a surface-active agent, (b) about 5 to 50% by weight of an alcohol, and (c) 0 to about 10% by weight of a non-polar solvent;

loading a black powder charge, said patch and a projectile into said firearm; and then firing said firearm, wherein said projectile and said patch are ejected from said firearm, thereby removing and preventing build-up of black powder residue upon a bore of said firearm which allows a shooter to repeatedly load and fire the firearm without manually cleaning the bore of the firearm after each shot.

* * * * *